US006009927A

United States Patent [19]

Peters

[11] Patent Number: 6,009,927

[45] Date of Patent: Jan. 4, 2000

[54] METHOD AND APPARATUS FOR INSTALLING CARPET

[76] Inventor: Ray A. Peters, Admirable Ent. Inc., 1911 Stevenson Dr., Ft. Myers, Fla. 33917

[21] Appl. No.: 09/132,212

[22] Filed: Aug. 11, 1998

[51] Int. Cl.[7] ..... B66F 19/00

[52] U.S. Cl. ..... 156/577; 156/574; 254/133 R; 414/461

[58] Field of Search ..... 156/574, 577, 156/538, 543; 414/461; 254/133 R

[56] References Cited

U.S. PATENT DOCUMENTS

| | | | |
|---|---|---|---|
| 2,643,856 | 6/1953 | Sales . | |
| 2,648,521 | 8/1953 | Sales . | |
| 2,824,036 | 2/1958 | Dykeman et al. . | |
| 3,831,791 | 8/1974 | Gonzales | 414/461 |
| 4,082,250 | 4/1978 | Allmon et al. . | |
| 4,194,726 | 3/1980 | Hance . | |
| 4,749,433 | 6/1988 | Johnston et al. . | |
| 4,790,059 | 12/1988 | Killpack . | |
| 4,846,443 | 7/1989 | Collins et al. . | |
| 4,861,219 | 8/1989 | Mayle | 414/461 |
| 5,234,197 | 8/1993 | Wurdack . | |
| 5,261,643 | 11/1993 | Wurdack . | |
| 5,385,335 | 1/1995 | Wurdack . | |
| 5,459,897 | 10/1995 | Wurdack . | |
| 5,529,287 | 6/1996 | Pelosi, Jr. et al. . | |

*Primary Examiner*—Daniel Stemmer
*Attorney, Agent, or Firm*—Richard C. Litman

[57] ABSTRACT

A method and apparatus for installing carpet which provides for assembling and suspending a wheeled gantry hoist over a work domain for lifting furniture or other objects in a work-space, raising the suspended furniture by as little as one-half inch, and subsequently installing rolled carpet beneath the furniture. The wheeled gantry hoist comprises a pair of mobile support trusses spanned by an elongated beam of sufficient length to permit the full width of the carpet to be passed thereunder. The beam suspends at least one ratchet winch adapted to lift modular office panels and furniture and be slidably and detachably suspended from the beam. The carpet roll, having been rolled onto a spindle, is horizontally supported by a mobile carriage for spooling out the carpet. A blower is disposed to force high-velocity air beneath adhesive carpet to lift the carpet and prevent adhesion of the carpet to the floor as the carpet is being pulled beneath the raised furniture to be set in place by an installer. The environment is thus readied for carpet to be set in place.

17 Claims, 4 Drawing Sheets

METHOD AND APPARATUS FOR INSTALLING CARPET

BACKGROUND OF THE INVENTION

1. Field of the Invention

The present invention relates generally to a method and apparatus for installing carpet and, more specifically, to a method and apparatus for installing carpet from rolls in work areas where work-stations are defined by movable walls and modular furniture.

2. Description of the Related Art

The unique setting of a commercial office presents multiple challenges for a carpet installer or remover. Typically, in commercial installations, the floor is often covered with a number of carpet tiles, about 18 inches wide on one side, developed in response to the need to carpet without removing the furniture and modular office panels that have become so prevalent in the office environment. Moreover, it is customary to cement the carpet to the floor to provide it with sufficient body to prevent undue wear.

However, to minimize office disruption, it is preferred not: to move the furniture and modular office panels when it comes time to replace the carpet. Otherwise each desk and work area must be cleared of all business supplies and personal items. All electrical, telephone and computer network systems must be disconnected and all computers, telephones, facsimile machines and so forth moved. The furniture or modular office panels are then disassembled as far as necessary and all of the items stored while the new carpet is being laid.

Moreover, when such furniture or similar obstacles are already in place, time and cost considerations become paramount to both the installer and the purchaser, as the increased number of paid workers on a moving and carpet crew increases such costs. A method and apparatus which significantly reduce the amount of energy and time expended over manual or conventional carpeting methods is still lacking.

Although various lifting mechanisms have been developed, few were developed in response to the need to carpet without significantly repositioning or packing furniture. Most notably, the patents of Wurdack (U.S. Pat. Nos. 5,234,197, 5,261,643 and 5,385,335), Wurdack (U.S. Pat. No. 5,459,897) and Pelosi, Jr. et al. (U.S. Pat. No. 5,529,287) each discuss the inherent problems with raising a complex of modular furniture without significantly disturbing it for the purpose of carpeting, but only provide solutions directed at lifting modular furniture over the very limited area sufficient to remove and place carpet tiles. For example, the Wurdack '197, '643, and '335 inventions are directed to simple floor-level jack stands which are configured to insert into and lift the tracks found on modular panels. Similarly, the Pelosi invention is a levering stand having an arm configured to Wurdack '897 invention is a specially designed crowbar, also designed for levering the feet of modular panels.

Likewise, U.S. Pat. No. 4,846,443 issued to Collins et al. discloses a floor covering installation tool for lifting partitions, furniture or similar structures. The mechanism is a floor-level jack for raising and lowering a bracket. The bracket includes a member for securing the bracket to the raising and lower jack mechanism. One or more separate lifting mechanisms are required to lift the furniture for insertion of block supports. The lifting method and apparatus used according to the instant invention is structurally different to those taught by Collins et al., Wurdack or Pelosi.

Moreover, such inventions presuppose the use of replacement carpet tile, and fail to consider or teach the use of such devices for effective laying of rolled carpet. Since laying rolled carpet eliminates the labor and time intensive need to place each individual tile, costs may be further reduced if an effective apparatus and method is provided wherein the modular furniture is left relatively undisturbed.

However, rolls of carpet present their own set of problems. The size and weight of a carpet roll is substantial, normally as much as 20 feet in width, several feet in diameter, and several hundred pounds in weight. Thus, to effectively lay such a carpet under typical conditions, the room must be cleared of furniture, the free end of the carpet is typically laid contiguous with a wall, and the remaining roll is rolled out. Obviously, such an approach would, however, be cost ineffective in a commercial application.

Again, the patent literature includes devices to handle such carpet rolls, although none teach a suitable apparatus or method of use as described by the present invention. For example, U.S. Pat. No. 3,831,791 issued to Gonzales discloses a carpet hoist having a winch disposed on a side of the frame structure of the hoist for attaching a strap and hook assembly to a roll of carpet. The frame structure of the hoist is straddled on four caster wheels which are interconnected by dual cross bars for rolling and structural support, respectively. The hoist taught by Gonzales is specifically used for transporting rolls of carpets of varying sizes on and off trucks. There is no teaching nor suggestion for a method and apparatus for installing carpet as herein described.

Even less relevant hoists are known. U.S. Pat. No. 2,648,521, issued to Sales, discloses a hoist having a central cylindrically shaped beam with two bars attached thereto via a cross bar in a triangular fashion. A pulley including rope attachment assembly is disposed on top of the beam for transmitting a tensional force from an object for lifting. While the jack provides lifting, the object is not completely lifted and issues of instability are prevalent for such a task. U.S. Pat. No. 2,648,521 issued also to Sales discloses a hoist having similar features as recited above, except that the pulley is disposed cantilevered to a central cylindrical bar disposed between two railing structures in a triangular fashion.

Other U.S. patents disclosing lifting devices which are generally relevant to the instant invention are those issued to Allmon et al. (U.S. Pat. No. 4,082,250), and Hance (U.S. Pat. No. 4,194,726). U.S. Patents issued to Dykeman et al. (U.S. Pat. No. 2,824,036), Johnston et al. (U.S. Pat. No. 4,749,433), and Killpack (U.S. Pat. No. 4,790,059) disclose carpet laying techniques which are also only generally relevant to the instant invention.

The present method and apparatus for installing carpet is different from the related art in that it provides a modular gantry hoist and method for removing all carpet types and installing rolled carpet, ultimately reducing manpower and equipment requirements. None of the above inventions and patents, taken either singularly or in combination, is seen to describe the instant invention as claimed. Thus, a method and apparatus for installing carpeting solving the aforementioned problems is desired.

SUMMARY OF THE INVENTION

The method and apparatus for installing carpet according to the invention includes, generally, assembling and suspending a wheeled gantry hoist over a work domain for lifting furniture or other objects in a work-space, raising the suspended furniture by as little as one-half inch, and subsequently installing rolled carpet beneath the furniture.

Specifically, the wheeled gantry hoist comprises a pair of mobile support trusses spanned by an elongated beam, preferably an aluminum I-beam, of sufficient length to permit the full width of the carpet to be passed thereunder. The gantry hoist is both mobile and collapsible for transport into and through office buildings, often having constrictive passages and narrow elevators. Each truss has a generally triangular and wheeled structural support for slidably receiving a tubular upright, the upright bisecting the support. A lifting arm depends perpendicularly from the upright, and includes a flanged track for receiving the underside of the I-beam. The I-beam suspends at least one ratchet winch (commonly known as a "come-along") adapted to lift modular office panels and furniture and be slidably and detachably suspended from the I-beam. Other straps or lifting accessories may be attached to the beam as needed. The beam is centrally hinged for folding, the hinge positioned on the underside of the I-beam to permit lifting forces to be opposingly directed through the beam halves against one another, which necessarily maintains the beam in an open position as the load increases.

The carpet roll, having been rolled onto a factory spindle, is horizontally supported by a mobile carriage for spooling out the carpet. A blower is disposed to force high-velocity air beneath the carpet to lift the carpet and prevent adhesion of the carpet to the floor as the carpet is being pulled beneath the raised furniture to be set in place by an installer. The carriage is optionally configured to include a plenum and tubular base frame which directs the air flow from the blower through the mobile carriage to outlet vents. The base thus serves as ducting from the blower to the vents which are permanently positioned to automatically direct the air flow beneath the carpet with any movement of the carriage. Once the carpet is set in place, the furniture is lowered onto the carpet, having been raised with insignificant disturbance, and the gantry hoist is repositioned for further removal and installation of carpet.

Accordingly, it is a principal object of the invention to provide a method and apparatus for installing carpet which minimizes manual labor.

It is another object of the invention to provide a method and apparatus for installing carpet which is easy to implement and set up.

It is a further object of the invention to provide a method and apparatus for installing carpet which provide ease of portability.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
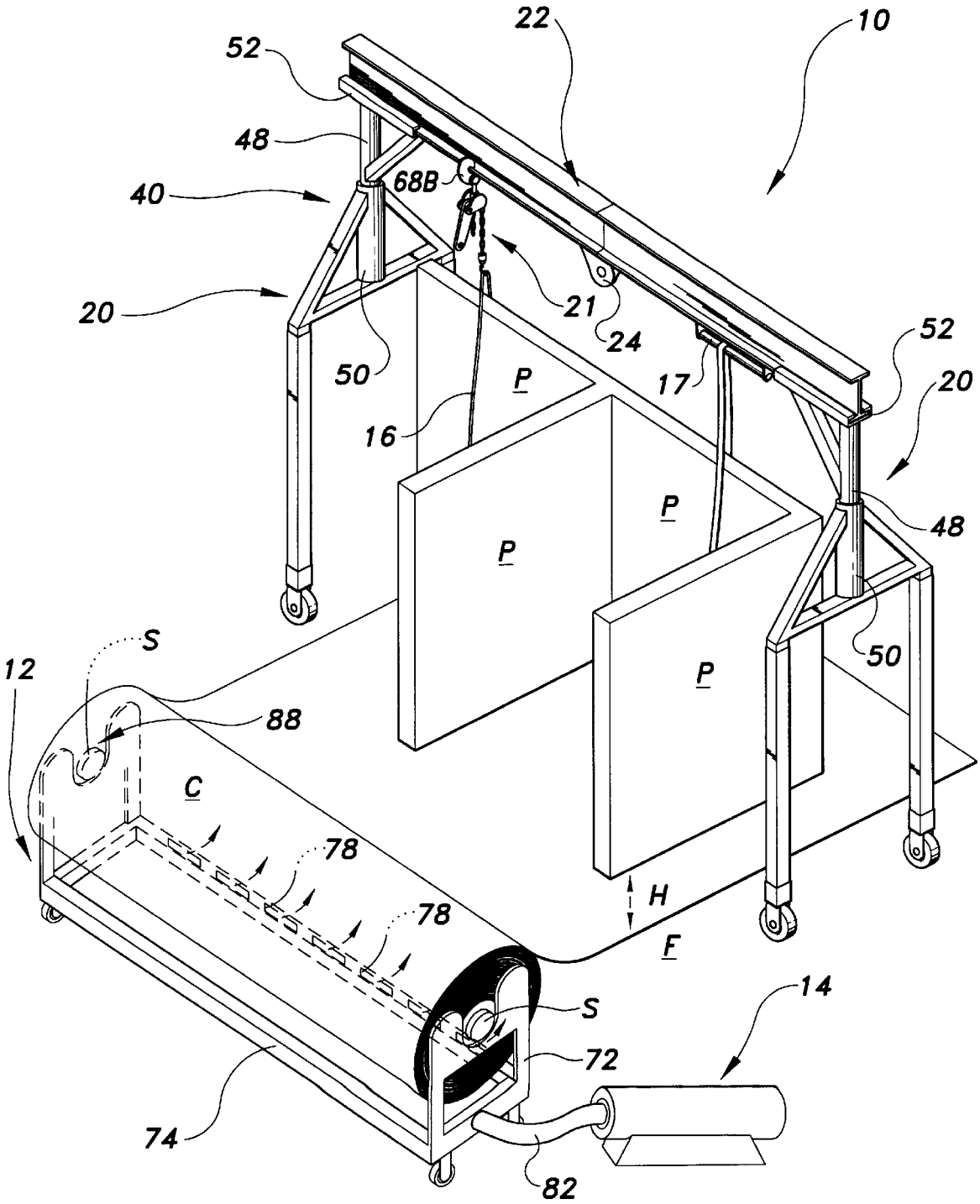
FIG. 1 is an environmental perspective view of the carpet installation apparatii used to implement the method of carpet installation, according to the present invention.

The present invention is a method and associated apparatii for installing and removing carpet in a furnished commercial office environment. A preferred embodiment of the present invention includes several necessary components by which the method is executed, which components are depicted in FIGS. 1–4. The components generally comprise 1) a gantry hoist 10 including a pair of wheeled support trusses 20 spanned by an elongated beam 22 from which at least one detachable winch 21 hangs, 2) a carpet carriage 12 for spooling a roll of carpet C, and 3) a conventional air blower 14.

The method for installing carpet includes the first step of assembling and positioning the gantry hoist 10 to suspend the furniture of the office work domain approximately ½ inch over the floor surface F. Typically, office carpet is no greater than ¼ inch in thickness; hence, although modular office furniture can be conceivably raised as high as necessary, constraints such as strains and stresses on the joints joining each modular unit dictate that the minimum amount of clearance be used to reduce the risk of damaging the structural integrity of the modular furniture or cubicle panel assembly during the lifting process. Therefore, ½ inch clearance is sufficient for carpet to be pulled under the modular assembly. Thus, gantry hoist 10 is dimensioned to have a beam 22 permitting a suitably large section of modular furniture to be suspended therefrom to permit clearance of the full width of the carpet C between the each of wheeled support trusses 20.

Figure 2:
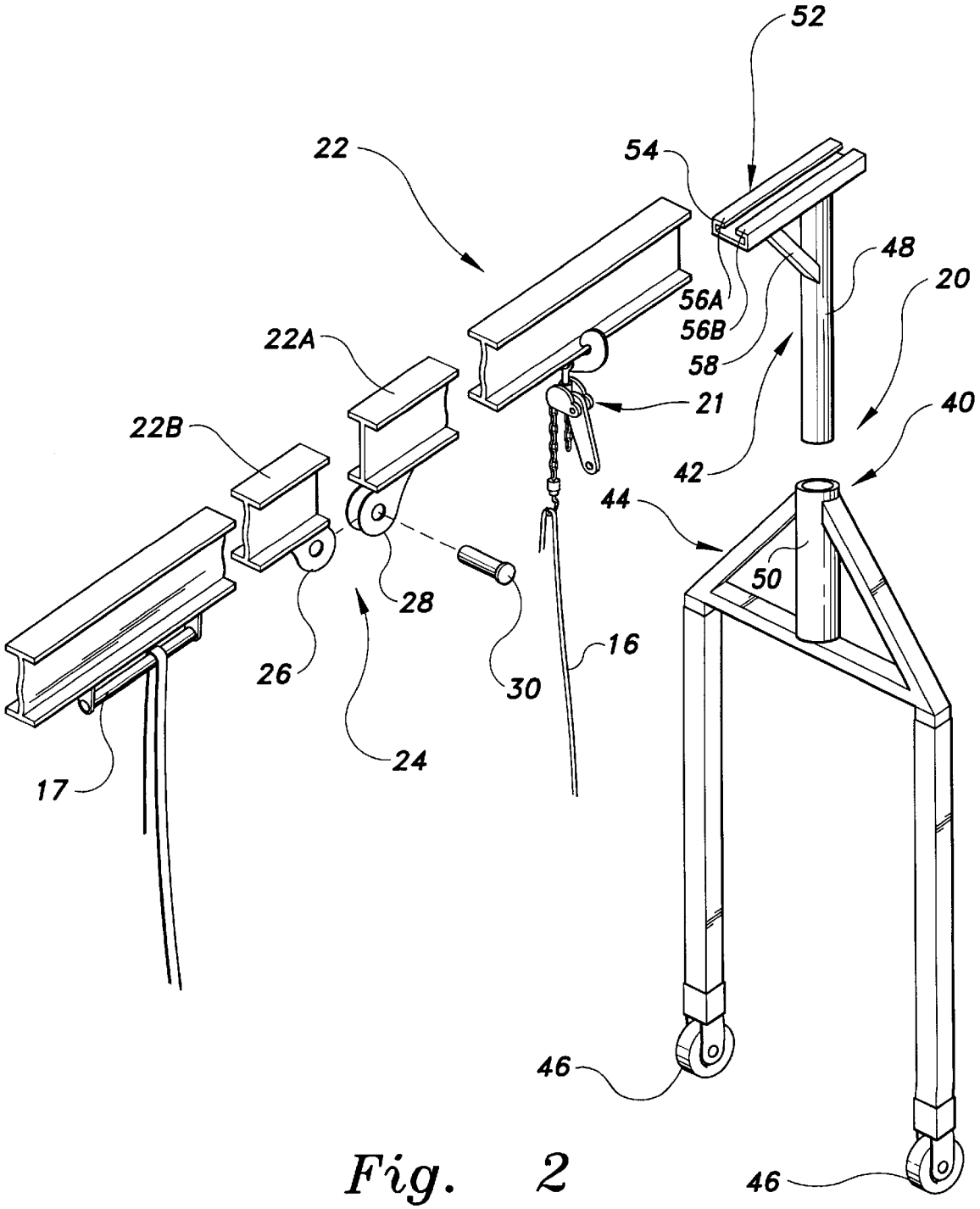
FIG. 2 is a partially fragmented and exploded, perspective view of the gantry hoist according the present invention, illustrating its collapsible and telescoping components.

As seen in FIG. 1 and FIG. 2, a lifting strap 16 attached to come-along winch 21 is suspended from the beam 22 of gantry hoist 10. In this example, the strap 16 is looped around, or otherwise attached to, a panel P. Other suitable attachment means may be used wherein suitable grappling devices specifically adapted for modular office furniture (which may be similar to, or part of, those described in the related art referenced above) may be adapted for use with the winch 21. Regardless of the type of device used, one panel P of a larger assembly is secured to the gantry hoist 10 and the winch 21 is then manually operated to suspend the entire assembly of panels P at the desired height as determined by the carpet installer or user. As noted above, the desired height h is preferably approximately ½ inch. Once such an assembly of modular office furniture is suspended, the existing carpet (usually carpet tiles) may be scraped and debris removed in preparation for installation of a new sheet of roll carpet.

The next step employs the mobile carriage 12, which provides the necessary maneuverability to position and to spool from the roll a sheet of carpet C under the suspended panels P. Either the floor or carpet is prepared at this stage for adhesion of the carpet C to the floor F in accordance with conventional carpet laying techniques. For example, a mastic or adhesive may be spread onto the floor, or, in the preferred alternative, the carpet may be factory prepared with an adhesive backing which is readied by removing a release liner.

However, to avoid premature adhesion while the sheet of carpet C is being spooled out (as suggested by FIG. 1), a blower 14 must also be positioned to direct a high-velocity air stream under the sheet of carpet C spooled from carriage 12. The air stream of the blower 14 must be sufficient to effectively lift the carpet C off of the floor surface; in practice, ¼ inch thick carpet flutters, caused by pressure waves passing beneath the carpet above the floor, which is adequate to avoid large areas of contact with the adhesive which might otherwise cause premature binding between the floor and carpet before the carpet is properly positioned. With the carpet properly set, the installation is completed by reversing the winching procedure, lowering the suspended panel P onto the carpet C.

Figure 3:
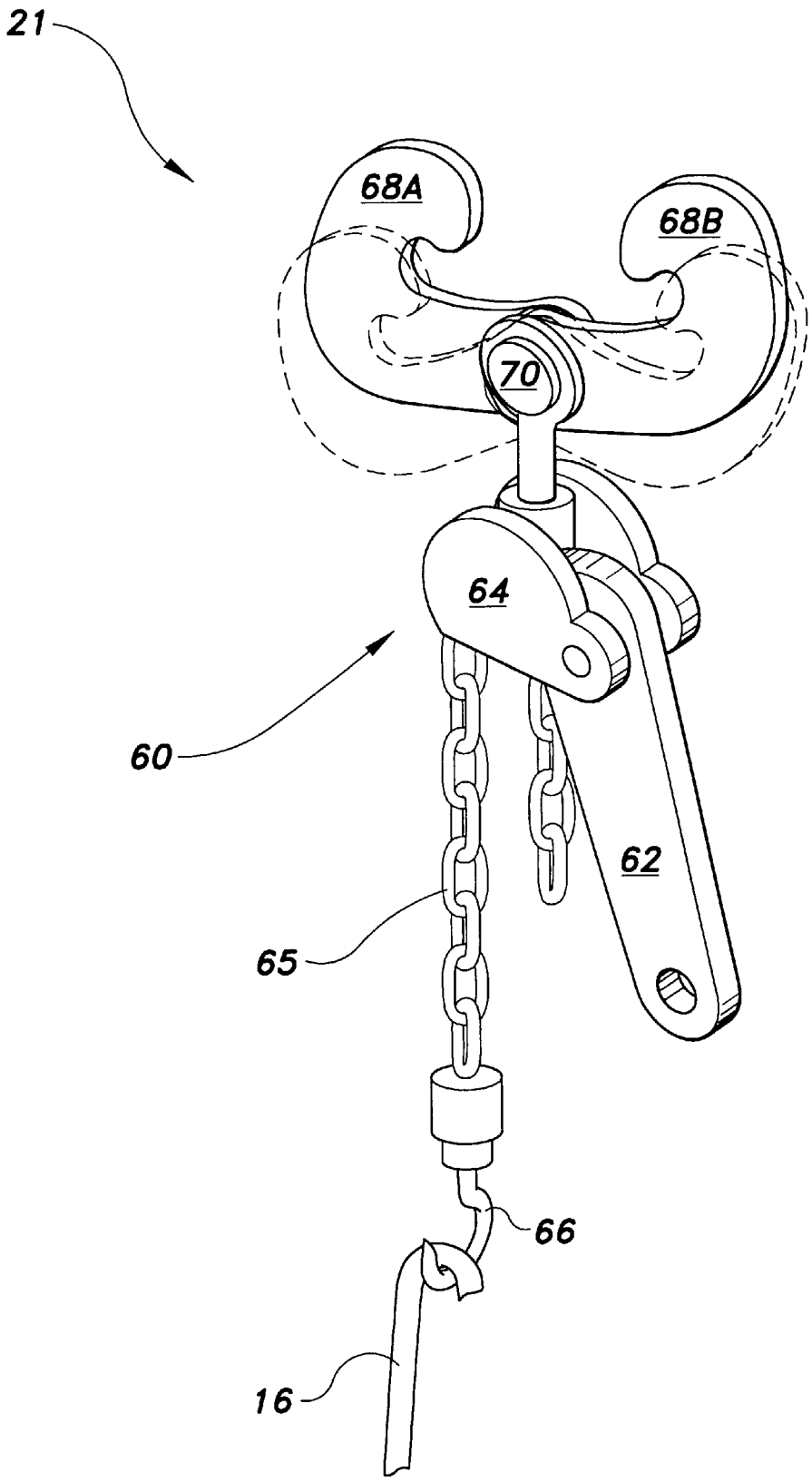
FIG. 3 is a detail, partial elevational view of the ratchet winch adapted for use with an I-beam span of the gantry hoist.
Figure 4:
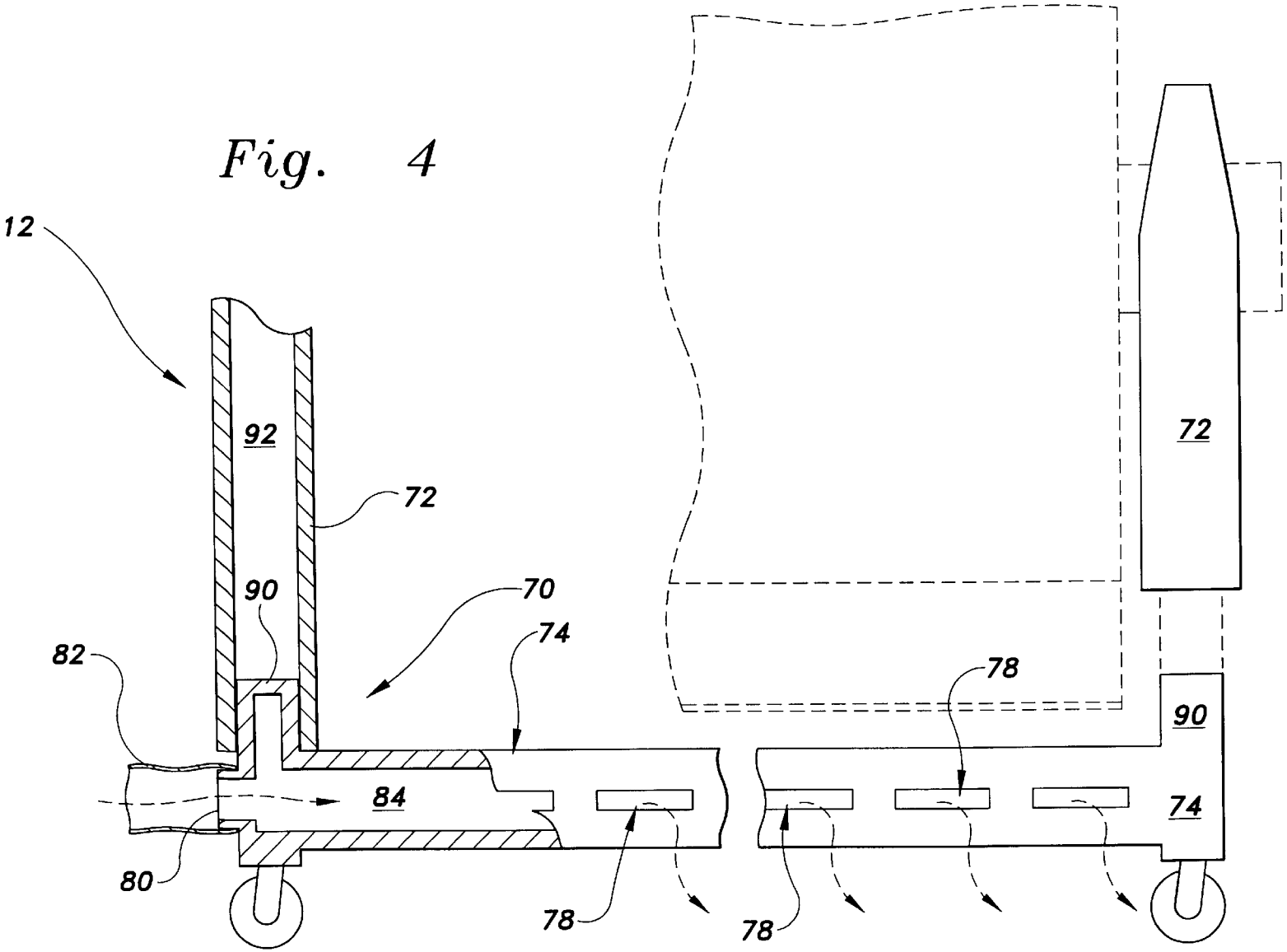
FIG. 4 is a detail, partially fragmented, exploded and sectional view of the carpet carriage, showing environmental details in phantom line.

In order to improve the efficiency of the above described method, the components for installing carpet by the above method have been specially modified. Turning now to FIGS. 2, 3, and 4, detail views of the specialized features of the gantry hoist 10, the ratchet winch 21, and carpet carriage 12, are respectively shown.

The wheeled gantry hoist 10 as shown in FIGS. 1 and 2 comprises a pair of mobile support trusses 20 spanned by an elongated beam 22. The beam 22 and support truss 20 are preferably constructed of aluminum to minimize weight, although other composite or structurally rigid materials suitable for bearing considerable weight may be used. The beam 22 is preferably an I-beam, for use with the modified winch 21 as later described, the beam 22 being of sufficient length to permit the full width of the rolled carpet to be passed thereunder. Such length may exceed twenty (20) feet. Thus, to make the gantry hoist easily transportable, each truss 20 is removable from the beam 22, and, the beam 22 is foldable.

The foldable beam 22 is best understood from FIG. 2, wherein hinge 24 is shown exploded. Hinge 24 is centrally positioned on beam 22, dividing beam 22 into first component 22*a* and second component 22*b*. As shown, the hinge 24 comprises a tongue 26 extending from second component 22*b*, and, a mating yoke 28 receiving tongue 26. Both yoke 28 and tongue 26 are joined by a hinge pin 30 received by holes 32 aligned in registry to form the hinge 24. The hinge pin 30 is preferably permanently installed. The hinge 24 is positioned on the underside of the I-beam to permit the downward vectors of lifting forces transmitted through winch 21 to be opposingly directed through the beam halves against one another, which necessarily maintains the beam in an open position as the load increases. However, other embodiments of the hinge may be incorporated.

The I-beam is a preferable beam 22 because it is commercially available and suitably configured to permit each truss 20 to be easily matingly configured to receive the I-beam and support it. Each truss 22 has a tubular frame 40 comprising separable parts, namely a top portion 42 and base portion 44, the base portion 44 including means for telescopingly receiving the top portion 42, and the top portion 42 including means for telescopingly receiving the beam 22 transversely to base portion 44.

In the preferred embodiment, the base portion 44 includes wheels 46 for mobility of the device, and, a journal 50 for telescopingly receiving the top portion 42. The journal 50 allows the top portion 42 not only to be removed for transport, but also to be momentarily raised from its resting position during assembly with the I-beam for ease of alignment. As shown in FIG. 2, the journal 50 is a tube integrally formed as part of the frame 40; the top portion 42 includes a tubular upright 48, the upright 48 sized to be closely received by the tube.

To receive the beam 22, a lifting arm 52 depends perpendicularly from the upright 48 and includes a flanged track 54 for receiving the lower of the I-beam. The track 54 includes flanges 56*a*,56*b* which lip the lower edges of the I-beam. This forms a T-shaped tongue and groove arrangement which permits rapid assembly and lateral, variable positioning of the trusses 20 along the I-beam 22, yet is structurally rigid against downward load forces. Accordingly, a brace 58 may also be provided as a support the upright 48 and the arm 52 for reinforcement and thereby reduce the risk of bending due to excessive loads.

Subject to the type of loads, the gantry hoist 10 for installing carpet can be made of metallic and/or composite plastic materials. However, according to the preferred invention, the hoist 10 is preferably made of aluminum. Alternatively, composite plastics are used for nonindustrial applications, since object loads are considerably reduced in weight. The plastic design (or casting) can also be used as a training tool to increase the handling experience of a potential carpet installer prior to entering the field.

The beam 22 suspends at least one sliding and detachable ratchet winch (commonly known as a "come-along") adapted to lift modular office panels and furniture, and may suspend other straps or lifting accessories as needed. For example, a strap attachment bar 17 may be included. As shown in FIG. 3 for use with the preferred I-beam 22, the adapted winch 21 includes a conventional come-along component 60, shown having a ratchet mechanism 64 and a lever arm 62 for manually turning the ratchet mechanism. Typically, a hook 66 is provided to which a strap 16 may be attached; however other known come-alongs are adapted to directly ratchet a strap which passes through the ratchet mechanism 64 in place of the chain 65 as shown. Regardless of the type of winch used, the adapted winch 21 further comprises a pair of grappling hooks 68*a*,68*b*, which are pivotally attached to a common pivot 70. The common pivot 70 is affixed to the ratchet mechanism 64. Each of the grappling hooks 68*a*,68*b* are configured to closely engage the T-shaped lower portion of the I-beam 22. The grappling hooks 68*a*,68*b* are opposed to one another such that, as the load increases on strap 16, the forces cause the opposed hooks 68*a*,68*b* to pivot inward toward one another, thereby securely gripping the I-beam 22. Thus, as soon as the load is released typically after completion of the installation of the new carpet, the winch 21 is permitted to be immediately laterally slid or attached to a different portion of the I-beam as the configuration of the furniture modules dictate for the next portion of the installation job. This advantage further improves the efficiency and speed by which the installation method described above can be accomplished.

Finally, turning now to FIG. 5, the mobile carriage 12 is shown adapted to more efficiently direct the air flow from blower 14 beneath the carpet C as it is being spooled from the carriage 12. The carriage 12 comprises a tubular frame 70 having a pair of support arms 72 upwardly depending and separable from a chassis 74, including wheels 76 for mobility. The support arms 72 are adapted to receive the ends of a spindle S onto which a carpet is factory rolled. In the preferred embodiment, the support arms 72 each define a recess 88 in which the spindle rests from above, held in place by gravity. The chassis 74 is generally rectangular and tubular and must be sized to space the support arms 72 sufficiently apart to receive a standard roll of carpet. To removably attach the support arms 72, each arm 72 is tubular and a corresponding mating stud 90 depends upwardly from the chassis 74 to be received by the cavity 92 defined by the tubular arm 72.

To direct air flow, the chassis 74 also defines an intake plenum 80, preferably positioned along a short side of the chassis 74, which plenum 80 receives a suitable adaptor 82 connected to air blower 14. The adaptor may be a flexible hose. A plurality of serially spaced exit ports 78 are defined along one long side of the chassis. The exit ports 78 are in communication with the plenum 80 by means of the internal passage 84 defined by the tubular chassis 74.

As is thus apparent, the carpet roll C may thus be freely suspended in the carriage 12 and revolved as the sheet of carpet is pulled therefrom. This eliminates the need to typically lay the free end of the carpet onto the floor and roll out the entire roll to a desired position thereby laying the carpet in place.

As should be now clearly apparent from the features of the apparatus, various embodiments of the invention may include an operational method for manipulating carpet in a furnished work domain comprising the steps of:

a) assembling a gantry hoist to suspend above the furnished work domain, b) attaching straps to an object for suspending the object a predetermined height, c) securing the object to the straps and the gantry hoist for suspension, d) unsecuring carpet from said work domain, e) removing carpet in a direction beneath and away from the suspended object for complete removal, and f) finishing the carpet removal by discarding debris;

g) installing new rolled carpet by spooling it beneath the raised furniture using a high velocity air blower to prevent premature adhesion; and h) then lowering and releasing the straps when the object is no longer suspended in the work domain.

It is to be understood that the present invention is not limited to the embodiments described above, but encompasses any and all embodiments within the scope of the following claims.

I claim:

1. An apparatus combination for installing carpet in a furnished work domain comprising:

a hoist gantry including a beam having a first end and a second end defining a predetermined length therebetween;

a pair of support trusses, each truss comprising a base portion and a top portion attached to the beam, the trusses spaced apart by the beam to have a predetermined distance in excess of the width of a standard roll of carpet;

a winch suspended from the beam, the winch adapted to raise furnishings; and a high velocity air blower.

2. The apparatus combination for installing carpet in a furnished work domain according to claim 1, wherein the base portion of each of the trusses includes wheels for mobility of the hoist gantry.

3. The apparatus combination for installing carpet in a furnished work domain according to claim 1, wherein the base portion and top portion are removably attached, including a journal for telescopically raising the top portion.

4. The apparatus combination for installing carpet in a furnished work domain according to claim 3, the top portion includes an upright member and wherein further the journal is a tube dimensioned to closely and telescopically receive the upright member.

5. The apparatus combination for installing carpet in a furnished work domain according to claim 1, wherein the top portion includes a lifting arm having means for telescopically joining the beam to the truss.

6. The apparatus combination for installing carpet in a furnished work domain according to claim 5, wherein the beam is an I-beam thereby integrally defining opposing T-shaped portions and the means for telescopically joining the beam includes a track having flanges for lipping and engaging a T-shaped lower portion of the I-beam.

7. The apparatus combination for installing carpet in a furnished work domain according to claim 1, wherein the beam is manufactured from aluminum.

8. The apparatus combination for installing carpet in a furnished work domain according to claim A, wherein the beam includes a hinge thereby defining a first component and a second component, the hinge centrally joining the first and second components.

9. The apparatus combination for installing carpet in a furnished work domain according to claim 8, wherein the beam is an I-beam having a lower T-shaped portion, and wherein further the hinge includes a yoke, a tongue and a pin joining the yoke and tongue, the yoke positioned on a lower side of the first component and the tongue positioned on a lower side of the second component, thereby defining abutting first and second components which rotate angularly through the pivot.

10. The apparatus combination for installing carpet in a furnished work domain according to claim 8, wherein the beam is an I-beam integrally defining opposing T-shaped portions.

11. The apparatus combination for installing carpet in a furnished work domain according to claim 10, wherein the winch includes a ratchet assembly and a pair of grappling hooks including a common pivot attached to the ratchet assembly, each of the grappling hooks configured to closely grip the T-shaped lower portion of the I-beam, the hooks opposing each other such that the pivot permits each hook to close upon the I-beam when a load is applied to the ratchet assembly.

12. The apparatus combination for installing carpet in a furnished work domain according to claim 1, wherein the winch includes a strap.

13. The apparatus combination for installing carpet in a furnished work domain according to claim 1, further including a carriage for spooling a roll of carpet including wheels for mobility.

14. The apparatus combination for installing carpet in a furnished work domain according to claim 13, wherein the carriage includes a tubular frame defining a plurality of exit ports, an intake plenum, and a channel therebetween, said exit ports positioned along said frame for directing air flow from said air blower under a sheet of carpet from a roll disposed on said carriage.

15. The apparatus combination for installing carpet in a furnished work domain according to claim 13, wherein the carriage comprises separable components including a wheeled chassis and a pair of support arms.

16. The apparatus combination for installing carpet in a furnished work domain according to claim 13, wherein the support arms include tubular ends, and, wherein further the wheeled chassis includes a plurality of studs depending upwardly sized to closely engage the tubular ends.

17. The apparatus combination for installing carpet in a furnished work domain according to claim 13, wherein the support arms include a recess sized to receive the spindle of a carpet roll.

* * * * *